United States Patent [19]

Lampert

[11] 4,083,155

[45] Apr. 11, 1978

[54] THERMALLY INSULATED ENCLOSURE

[76] Inventor: Albert J. Lampert, 605 Avenue Teresa, San Clemente, Calif. 92672

[21] Appl. No.: 777,059

[22] Filed: Mar. 14, 1977

[51] Int. Cl.[2] ..... E04B 1/80

[52] U.S. Cl. ..... 52/93; 52/263; 52/484; 52/486; 52/509; 110/331; 110/338

[58] Field of Search ..... 52/83, 93, 483, 484, 52/506, 509, 513, 263, 486; 110/1 A, 99 R; 266/280, 285

[56] References Cited

U.S. PATENT DOCUMENTS

| | | | |
|---|---|---|---|
| 2,001,215 | 5/1935 | Ruppel | 52/93 X |
| 2,144,598 | 1/1939 | Brinckerhoff et al. | 110/1 A |
| 2,147,946 | 2/1939 | Jaros | 110/1 A |
| 2,270,161 | 1/1942 | Briggs | 52/263 X |
| 2,277,984 | 3/1942 | Jenkins | 110/1 A |
| 3,783,566 | 1/1974 | Nielson | 52/585 X |
| 3,892,396 | 7/1975 | Monaghan | 52/486 X |
| 3,952,470 | 4/1976 | Byrd, Jr. | 52/513 X |
| 3,990,203 | 11/1976 | Greaves | 52/506 |
| 4,001,996 | 1/1977 | Byrd, Jr. | 52/509 |

*Primary Examiner*—Alfred C. Perham
*Attorney, Agent, or Firm*—Fulwider, Patton, Rieber, Lee & Utecht

[57] ABSTRACT

A free standing thermal enclosure for use as part of an oven, furnace or refrigeration system, including a plurality of adjoining insulating walls and a ceiling spaced inwardly from and supported by an open skeletal framework. The walls and ceiling are formed by interlocking, non-structural pads of a pliant, low density, insulating material that can be made of interlaced ceramic fibers.

15 Claims, 7 Drawing Figures

THERMALLY INSULATED ENCLOSURE

BACKGROUND OF THE INVENTION

The present invention relates to thermally insulated structures of a type used in connection with furnaces, ovens, refrigeration facilities and the like.

In the construction of furnaces and other relatively large thermally insulated structures, it is conventional to build solid walls of heavy, rigid, structural blocks, such as refractory bricks, by which the heat is contained. A steel or aluminum frame is often used to reinforce the blocks and hold them in position, the frame being either integral with the blocks or immediately adjacent their exterior surfaces. A layer of soft, pliable, refractory material, usually available in roll form, is sometimes affixed to the interior surface of the blocks for added thermal insulation.

The construction of furnaces in the above conventional manner entails high labor costs, and once completed, the structure has certain inherent functional drawbacks. The metal frame that is integral or contiguous with the bricks is thermally conductive and may act as a radiator to significantly diminish the heat retention ability of the furnace. If the use to which the furnace is put presents the possibility of an explosion, the blocks themselves are a danger because they can become projectiles, each capable of inflicting serious injury or doing substantial damage.

SUMMARY OF THE INVENTION

The present invention provides a highly effective thermally insulated enclosure that can be easily and quickly erected at low cost. It includes an open skeletal framework with solid walls and a ceiling that are spaced inwardly from the framework. The walls and ceiling are formed by non-structural insulating pads, the sides of the pads being exposed and substantially free of contiguous supporting structure.

In a preferred embodiment, the framework is formed by substantially rigid tubular members that define a three-dimensional space in which the walls and ceiling are located. The pads are mutually interlocking and supported by hangers that extend inwardly from the framework. The hangers can be movable along the framework to accommodate the position of the pads.

A preferred pliant, low-density material for the pads is formed by ceramic fibers. This material is highly refractory and suitable for use in ovens and furnaces, as well as refrigerated facilities.

Other features and advantages of the present invention will become apparent from the following detailed description, taken in conjunction with the accompanying drawings which illustrate, by way of example, the principles of the invention.

DESCRIPTION OF THE PREFERRED EMBODIMENT

Figures 1, 2, 3, 4, 5, 6, 7:
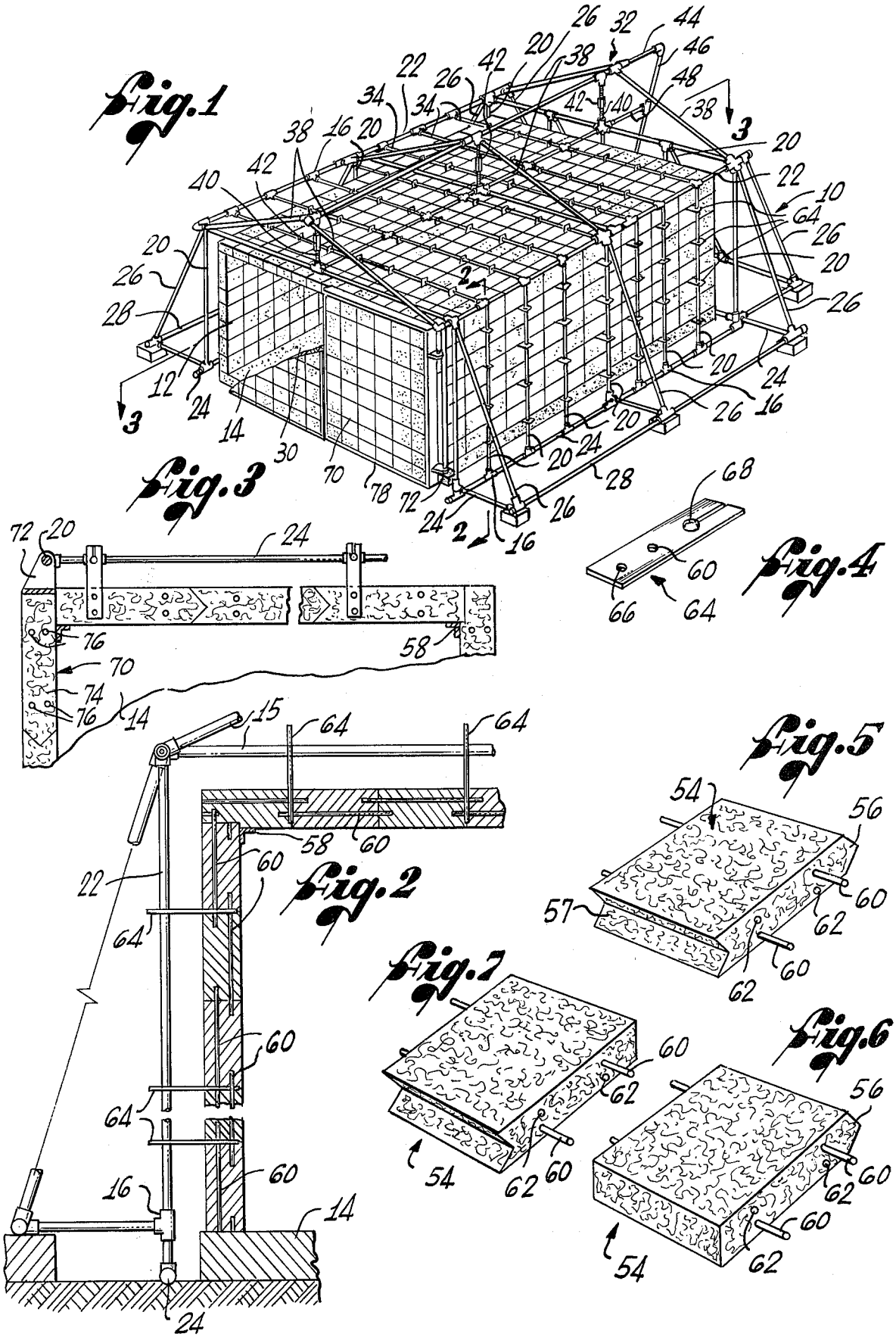
FIG. 1 is a perspective view of a thermally insulating structure formed by interlocking pads and a skeletal framework constructed in accordance with the invention.
FIG. 2 is a fragmentary sectional view of a portion of the structure of FIG. 1, taken along the line 2 — 2.
FIG. 3 is a fragmentary sectional view of one side of the structure of FIG. 1, taken along the line 3 — 3 of FIG. 1.
FIG. 4 is a perspective view of a hanger used to support the pads.
FIGS. 5, 6 and 7 are perspective views of various pads used in the structure of FIG. 1.

An exemplary thermally insulated structure appropriate for heat treating metals, embodying the novel features of the present invention is illustrated in the accompanying drawings. In general, the structure includes an open, skeletal, metal framework 10 and a housing 12 supported by the framework and spaced inwardly therefrom, as shown in FIG. 1. A floor 14 beneath the framework 10 is formed of cast concrete or other suitable material.

The framework 10 is constructed of steel or aluminum tubular members connected by T-joints 16. Its walls 18 are formed by a series of parallel uprights 20 connected at their top and bottom ends to upper and lower horizontal members 22 and 24, respectively. There are four upper members 22 arranged in a square or rectangle and three lower members 24 arranged in a U-shape along the sides and back of the framework 10. Inclined buttress members 26 extend downwardly from the upper members 22 at the sides and rear of the framework 10, terminating at points spaced outwardly from the lower members 24 where they are attached to outer horizontal members 28 that are parallel to the lower members. The front 30 of the framework 10 is open to permit unobstructed access to its interior.

The framework 10 also has a gable roof 32 formed by a plurality of parallel, horizontal cross members 34 that extend from side to side between two of the upper members 22. A ridge pole 36 perpendicular to the cross members 34 is centered over the roof and supported on each side by a plurality of roof brackets 38 that extend outwardly and downwardly to the two above-mentioned upper members 22. Short vertical struts 40 connect the ridge pole 36 to the longitudinal centers of the cross members 34, each strut being divided into two pieces connected end to end by a tension-adjusting turnbuckle 42. At the back of the framework 10, opposite the open front end 30, the ridge pole 36 extends beyond the rearmost uprights 20. The extended end 44 is connected to the rear lower member 24 by a back brace 46 that is angled downwardly and inwardly. A short horizontal strut 40 ties the back brace 46 to the rear upper member 22.

The housing 12 within the framework 10 has three insulating walls 50 and a ceiling 52 that are formed by interlocking pads 54. These pads 54 are essentially nonstructual, i.e., they are substantially incapable of forming a free standing structure without external support from the framework 10. The refractory material of the pads 54 is soft, pliant, relatively resilient and low in density. In this embodiment, it is a naturally occuring alumina-silica fire clay called kaolin formed into fibers 4 to 10 inches long that are interlaced to form a ceramic wool. Material of this nature is presently sold by the Babcock & Wilcox Company under the trademark KAOWOOL. It has a melting point of approximately 3200° F.

To facilitate the desired interlock, one vertical end 56 of each pad 54 has a V-shaped protrusion and the opposite end 57 has a corresponding V-shaped recess. The protrusions 56 are received by the recesses 57, thereby minimizing thermal losses between the pads (FIG. 5).

Other interlocking arrangements, such as a tongue and groove, ball and socket, or a shiplap can be used instead. The pads 54 that form corners are an exception, being square-cut at one end (FIGS. 6 and 7) and insulating strips 58 are laid internally along the corners to compensate for the fact that those pads do not interlock.

Elongated bores extend vertically into each pad 54, and a retaining rod 60 is inserted in each bore so that it projects from the top and bottom of the pad into a socket 62 in the pad above or below. Vertically adjacent rods 60 are alternately closer to the interior and exterior surfaces of the walls 50 and ceiling 52, as shown in FIG. 2, so that they do not interfere with each other.

The pads 54 are attached to the framework 10 by flat, plate-like hangers 64 (FIG. 4) that extend horizontally toward the walls 50 or vertically toward the ceiling 52. At its inner end, inserted between two vertically adjacent pads 54, each hanger 64 has two small apertures 66 that slidably receive two parallel and adjacent retaining rods 60, one projecting upwardly and the other projecting downwardly. A larger aperture 68 at its other end slidably receives one of the uprights 20. Differences in the thermal expansion of the components of the structure are therefore taken up by the vertical floating movement of the hangers 64 on the uprights 20 and the rods 60, as well as by the resiliency of the pads 54.

At the open front end 30 of the framework 10, the opposing sidewalls 50 of the housing 12 are connected by two doors 70 pivotably supported at their outer vertical edges by outwardly extending eccentric hinges 72 mounted on the nearest uprights 20, as shown in FIG. 3. Each door 68 is formed by a plurality of interlocking pads 74 and retaining rods 76 similar to those used in the walls 50 and ceiling 52, except that no hangers are provided. Instead, the doors 66 have peripheral rectangular metal frames 78 which, in view of the relatively small size of the doors, provide sufficient suport.

Since the present invention eliminates the usual heavy structural blocks of conventional construction, shipping costs are greatly reduced, as is the number of man hours and the degree of skill required for assembly. The framework 10 does not act as a radiator or thermal conductor because it is spaced from the pads 54, thereby increasing the thermal efficiency of the structure. Due to their comparatively small size, the retaining rods 60 and hangers 64 do not result in significant heat losses. In the event of an explosion, the soft light pads 54 are merely blown out through the open framework 10 without danger to persons and property in the area that would result if the enclosure were constructed in the conventional manner. It should also be noted that the invention readily lends itself to construction from prefabricated component parts.

While a particular form of the invention has been illustrated and described, it will be apparent that various modifications can be made without departing from the spirit and scope of the invention.

I claim:

1. A free standing, thermal enclosure comprising:

a substantially rigid skeletal framework defining a substantially rectangular three-dimensional space, said framework including a centrally disposed, horizontal ridge pole and a plurality of inclined buttress members;

a plurality of adjacent solid walls and a ceiling disposed within said framework and spaced inwardly therefrom, said walls and ceiling being formed by interlocking non-structural pads consisting of a pliant low density insulating material made of ceramic fibers, the sides of said pads being exposed and substantially free of contiguous supporting structure along the interior and exterior surfaces of said walls and ceiling, said pads having elongated vertical openings therein;

a plurality of hangers extending inwardly from said framework and inserted between said pads; and a plurality of rods inserted in said openings, said rods being engaged by said hangers.

2. The thermal enclosure of claim 1, wherein said hangers are plate-like members movable along said framework.

3. The thermal enclosure of claim 2, wherein said interlocking pads have V-shaped vertical ends.

4. A free standing, thermal enclosure comprising:

a substantially rigid, open, skeletal framework defining a three-dimensional space;

a plurality of adjacent solid walls and a ceiling disposed within said framework and spaced inwardly therefrom, said walls and ceiling being formed by non-structural pads consisting of a pliant low density insulating material made of ceramic fibers, the sides of said pads being exposed and substantially free of contiguous supporting structure along the interior and exterior surfaces of said walls and ceiling, said pads having openings therein;

a plurality of hangers extending inwardly from said framework and inserted between said pads; and a plurality of rods inserted in said openings, said rods being engaged by said hangers.

5. The thermally insulating enclosure of claim 4, wherein said framework is formed of steel or aluminum tubular members.

6. The thermally insulating enclosure of claim 4, wherein said hanger means are slidable on said framework for movement therealong.

7. The thermally insulating enclosure of claim 4, wherein said framework includes a centrally disposed, horizontal ridge pole and a plurality of inclined buttress members.

8. The thermal enclosure of claim 4 wherein said pads have interlocking ends.

9. The thermal enclosure of claim 8, wherein said hangers are plate-like members movable along said framework.

10. The thermal enclosure of claim 9, wherein said openings and said interlocking ends extend vertically.

11. The thermal enclosure of claim 8, wherein said interlocking ends are V-shaped.

12. A roof for a thermal enclosure comprising:

a substantially rigid open skeletal framework to be positioned atop the walls of said thermal enclosure;

a ceiling disposed inwardly from said framework, said ceiling being formed by non-structural pads consisting of pliant low density insulating material made of ceramic fibers, the sides of said pads being exposed and substantially free of contiguous supporting structure along the exterior surface thereof, said pads having openings therein;

a plurality of hangers extending inwardly from said framework and inserted between said pads; and a plurality of rods inserted in said openings, said rods being engaged by said hangers.

13. The thermal enclosure of claim 12 wherein said pads have interlocking ends.

14. The thermal enclosure of claim 13 wherein said interlocking ends are V-shaped.

15. The roof of claim 12 wherein said framework includes a centrally disposed ridge pole.

* * * * *